US005080079A

United States Patent [19]

Yoshida et al.

[11] Patent Number: 5,080,079

[45] Date of Patent: Jan. 14, 1992

[54] FUEL INJECTION APPARATUS HAVING FUEL PRESSURIZING PUMP

[75] Inventors: Yutaka Yoshida, Kariya; Eiji Sakagami, Anjo, both of Japan

[73] Assignee: Aisin Seiki Kabushikiki Kaisha, Kariya, Japan

[21] Appl. No.: 587,090

[22] Filed: Sep. 24, 1990

[30] Foreign Application Priority Data

Sep. 22, 1989 [JP] Japan ..... 1-245038

[51] Int. Cl.[5] ..... F02M 43/00

[52] U.S. Cl. ..... 123/531; 123/498; 239/585

[58] Field of Search ..... 123/531, 533, 498, 527; 239/88, 91, 95, 409, 585

[56] References Cited

U.S. PATENT DOCUMENTS

| | | | |
|---|---|---|---|
| 2,682,866 | 7/1954 | Rhoades, Jr. | 123/527 |
| 3,186,393 | 6/1965 | Neil | 123/527 |
| 4,149,497 | 4/1979 | Zeliszkewycz | 123/533 |
| 4,617,904 | 10/1986 | Pagdin | 123/527 |
| 4,774,909 | 10/1988 | Dolderer | 123/527 |
| 4,782,807 | 11/1988 | Takahashi | 123/498 |
| 4,844,339 | 7/1989 | Sayer et al. | 239/585 |
| 4,899,714 | 2/1990 | Schechter et al. | 123/533 |
| 4,943,004 | 7/1990 | Takahashi | 239/95 |
| 4,974,571 | 12/1990 | Oppenheim et al. | 123/531 |

*Primary Examiner*—Willis R. Wolfe
*Assistant Examiner*—Robert E. Mates
*Attorney, Agent, or Firm*—Oblon, Spivak, McClelland, Maier & Neustadt

[57] ABSTRACT

A fuel injection apparatus has a piezoelectric element for generating a high-pressurized air-fuel gas mixture. The piezoelectric element is arranged at a side of a pumping chamber, and a diaphragm is arranged between the piezoelectric element and the pumping chamber. The piezoelectric element produces a pumping function in accordance with a current signal.

12 Claims, 2 Drawing Sheets

FUEL INJECTION APPARATUS HAVING FUEL PRESSURIZING PUMP

BACKGROUND OF THE INVENTION

1. Field of the Invention

The present invention relates generally to a fuel injection apparatus, and more particularly to a fuel injection apparatus for an internal combustion engine.

2. Description of the Related Art

A fuel injection apparatus is often used in, for example, an internal combustion engine for controlling the power generated by the internal combustion engine. A conventional fuel injection apparatus is, for example, disclosed in Japanese patent laid-open publication 62(1987)-93481 The conventional type fuel injection apparatus is shown in FIG. 2.

Referring now to the FIG. 2, the fuel injection apparatus 50 basically includes a main body 51, a solenoid valve 52, a valve shaft 53 and a valve holder 54. A fuel chamber 55 is defined in the main body 51. An air conduit 56 is formed in the main body 51 for introducing pressurized air to the fuel chamber 55. A fuel inlet port 57 is arranged in the main body 51. Fuel conduits 58*a* and 58*b* are connected with the main body 51. A fuel tank 59 is connected with the fuel conduit 58*a*, and a fuel pump 60 is arranged between the fuel inlet port 57 and the fuel tank 59. A fuel injector 61 is arranged on a surface of the main body 51. A fuel supplying rate to the fuel chamber 55 is controlled by the fuel injector 61.

The solenoid 52 is arranged on an upper portion of the main body 51, and the solenoid 52 is covered with an outer cover 52*a*. The axial movement of valve shaft 53 is controlled in accordance with an operating condition of the solenoid 52. The cylindrical shaped valve holder 54 is connected with the main body 51, and the valve shaft 53 penetrates through the main body 51 and the valve holder 54. Fuel and pressurized air are mixed uniformly in the fuel chamber 55.

In operation, an electrical signal is applied to the solenoid 52. This energizes the solenoid 52 and moves the valve shaft 53 to the open position. When the electrical signal is not applied to the solenoid 52, the valve shaft 53 does not move and the valve shaft 53 remains at the closed position as shown in FIG. 2. The air-fuel ratio is controlled in accordance with the operation of the fuel injector 61.

There are problems in the above-described design or arrangement. In operation, a high speed pumping operation and/or a high compression mixing operation are required for generating a desired air-fuel mixture. Particularly in a 2-cycle type internal combustion engine, a high pressure air-fuel mixture is required for injection in the engine during a compression phase thereof. However, the described known art cannot establish a high speed and/or high compression mixing operation.

SUMMARY OF THE INVENTION

Accordingly, it is one of the primary objects of the present invention to generate a high speed pumping operation of the fuel injection apparatus.

It is another object of the present invention to generate a high pressurize an air-fuel mixture in a fuel injection apparatus.

It is still another object of this invention to provide a new and advanced type fuel injection apparatus.

It is further object of this invention to produce a fuel injection apparatus to solve the above described drawbacks of the conventional fuel injection apparatus.

The above, and other, objects are achieved according to the present invention by a fuel injection apparatus for supplying a fuel mixture to a combustion chamber of an engine. The apparatus includes a main body having a fuel path, injector valve means connected to the main body and in communication with the fuel path, a mixing chamber connected to the fuel path for mixing the fuel with air to form a fuel chamber, and injector valve drive means connected to the main body to selectively open the injector valve so as to supply the fuel mixture to the combustion chamber at a controlled rate. According to the invention, there is also included a gaseous fuel pressurizing pump in communication with the fuel path, so that the fuel is rapidly pressurized.

According to a further feature of the invention, the pressurizing pump includes a pressurizing chamber communicating with the fuel path, a piezoelectric element capable of expanding and contracting in response to electrical pulses, and means for transferring expansions and contractions of the piezoelectric element to the pumping chamber, so as to pump fuel in the pumping chamber. The pumping chamber also includes inlet and outlet valves.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
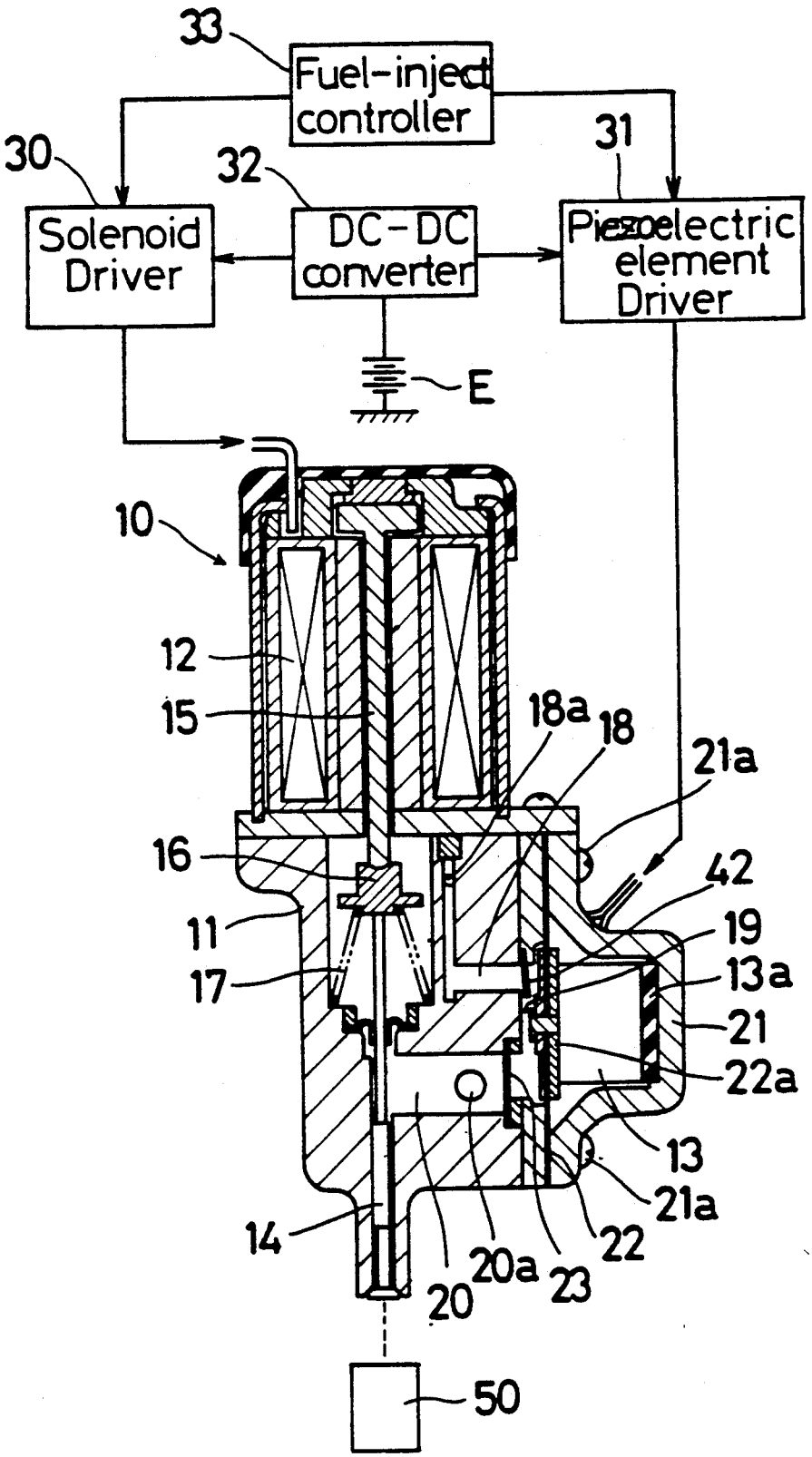
FIG. 1 is a cross sectional view of a fuel injection apparatus according to the present invention.
Figure 2:
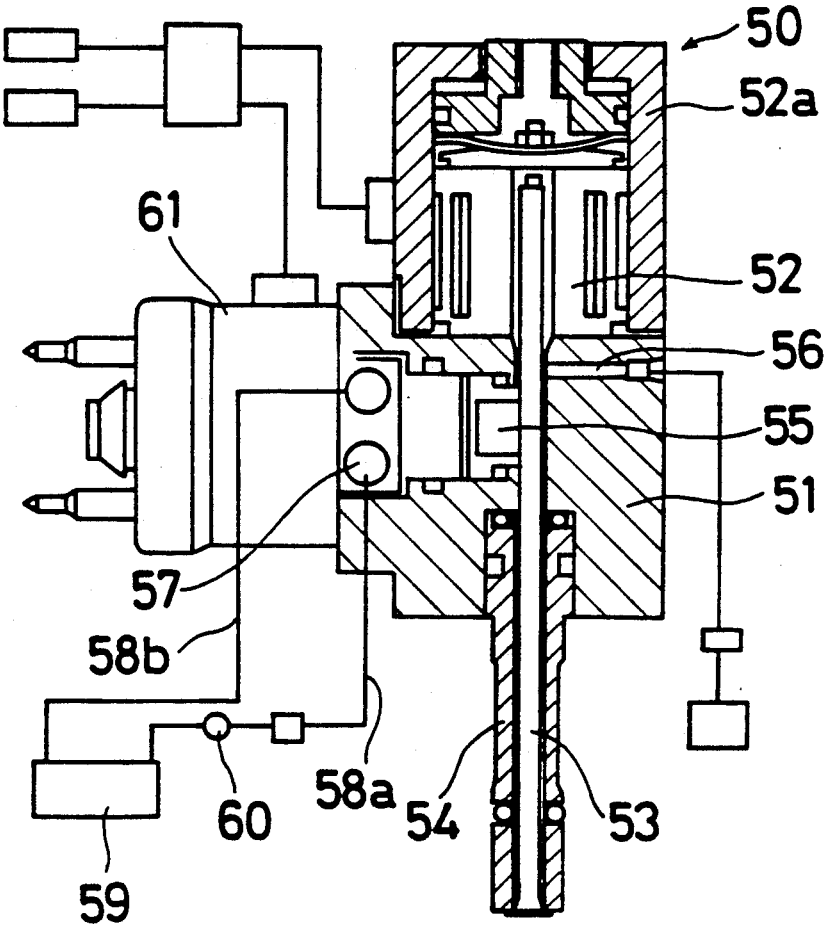
Fig. 2 PRIOR ART
FIG. 2 is a cross sectional view of a conventional fuel injection apparatus.

In the preferred embodiment, a fuel injection apparatus 10 may be used, for example, in an internal combustion engine of an automobile. FIG. 1 shows a cross sectional view of the fuel injection apparatus for an internal combustion engine (not shown). In the present invention a piezoelectric element produces a pumping operation for generating an air-fuel mixture.

Referring to the FIG. 1, the fuel injection apparatus 10 basically includes a main body 11, a solenoid 12, a piezoelectric element 13 and a valve shaft 14 (injector valve means). A movable core 15 is slidably arranged in the solenoid 12. A spring seat 16 is arranged at the end portion of the movable core 15 and a spring 17 is arranged between the spring seat 16 and the main body 11. Under a non-energized condition of the solenoid 12, the spring 17 pushes the valve shaft 14 to its closed position. The spring seat 16 and the valve shaft 14 are united into one body. A fuel path 18 connects to a pumping chamber 19 and a mixing chamber 20 defined in the main body 11. The bore of the valve shaft 14 establishes a communication between the mixing chamber 2 and a combustion chamber 50 of the engine.

The piezoelectric element 13 which has a pumping function is arranged at a side portion of the pumping chamber 19. A pump housing 21 is connected with the main body 11 by a plurality of bolts 21*a* (only one is shown). A diaphragm 22 is arranged between the main body 11 and the pump housing 21. A pumping plate 22a is mounted to the diaphragm 22. The piezoelectric element 13 is fixedly held between the pumping plate 22a and the pump housing 21. An elastic plate 13a is arranged between the piezoelectric element 13 and the pump housing 21. A first (inlet) one-way valve 42 is arranged between the fuel path 18 and the pumping chamber 19. The fuel flow to the pumping chamber, 19 is permitted by the first one-way valve 42. A second (outlet) one-way valve 3 is arranged between the pumping chamber 19 and the mixing chamber 20. The fuel flow to the mixing chamber 20 is permitted by the second one-way valve 23. Each of the first and second one-way valves 22 and 23 is in the form of a elastic plate. A fuel inlet port 18a is formed on the main body 11. The fuel is introduced to the fuel path 18 via the fuel inlet port 18a. Further, the fuel is introduced to the pumping chamber 19 and a high pressurized fuel gas is generated by the oscillations of the piezoelectric element 13, the oscillations being transferred to the pumping chamber by the pumping plate 22a. The high pressurized fuel gas is introduced to the mixing chamber 20. An air inlet port 20a is formed on the main body 11. Pressurized air is provided to the mixing chamber 20 via the air inlet port 20a. In the mixing chamber 20, a pressurized air-fuel gas is quickly generated.

A solenoid driver 30 is electrically connected with the solenoid 12, and a piezoelectric element driver, 31 is electrically connected with the piezoelectric element 13. The piezoelectric element driver 31 produces a pulse signal. The pulse signal causes the piezoelectric element 13 to repeatedly expand and contract. A power supply or current source E is electrically connected with the solenoid driver 30 and the piezoelectric element 31. A DC-DC converter 32 is arranged between the current source E and the solenoid driver 30 and the piezoelectric element 31. The DC-DC converter 32 transforms the voltage of the current source E. In this embodiment, a 100 volt direct current is generated by the DC-DC converter 32. A fuel injection controller 33 is connected to the solenoid driver 30 and the piezoelectric element driver 31. The fuel injection controller 33 determines a fuel injection timing and the pulse frequency of the piezoelectric element driver 31.

The principal operation of this embodiment is similar to that of the conventional fuel injection apparatus described earlier. That is, the solenoid causes the valve shaft 14 to operate, opening and closing the valve. When an electrical signal is applied to the solenoid 12, this energizes the solenoid 12 and moves the valve shaft 14 to the open position. The air-fuel flow is thus supplied to an internal combustion engine (not shown).

Under normal operating conditions, the fuel is provided to the pumping chamber 19. Due to its expansion and contraction, a pumping function is generated by the piezoelectric element 13. The pumping function of the piezoelectric element occurs in accordance with an operating signal from the piezoelectric element driver 31. That is, the expansion of the piezoelectric element 13 presses the pumping plate 22a into the pumping chamber, compressing and pumping the gaseous fuel therein. Upon contraction of the piezoelectric element 13, the diaphragm causes the pumping plate to return to the right (as seen in FIG. 1), thereby expanding the pumping chamber and opening the first one-way valve 42 to admit more fuel. The fuel is thus pressurized. When the fuel pressure is sufficient, the second one-way valve 23 is opened by the fuel pressure during expansion of the piezoelectric element 13. The pumping frequency is determined by the injection controller 33, and a suitable operating condition is established.

When a high speed pumping operation and/or a high pressurized air-fuel mixture is required from the fuel injection apparatus, the piezoelectric element can obtain the desired operating conditions.

The invention has been described in an illustrative manner, and it is to be understood that the terminology which has been used in intended to be in the nature of words of description rather, than of limitation.

Obviously, many modifications and variations of the present invention are possible in light of the above teachings. It is, therefore, to be understood that within the scope of the appended claims, the invention may be practiced otherwise than as specifically described.

We claim:

1. A fuel injection apparatus for supplying a fuel mixture to a combustion chamber of an engine, comprising:

a main body having a fuel path;

an injector valve connected to said main body and in communication with said fuel path;

a mixing chamber connected to said fuel path for mixing the fuel with air to form a fuel mixture;

injector valve drive means connected to said main body to selectively open said injector valve so as to supply the fuel mixture to the combustion chamber at a controlled rate; and a fuel pressurizing pump in communication with said fuel path, whereby the fuel is rapidly gasified and pressurized, said pump including a piezoelectric element.

2. The fuel injection apparatus of claim 1 wherein said pressurizing pump further comprises:

a pumping chamber in said main body and communicating with said fuel path; and means for transferring expansions and contractions of said piezoelectric element to said pumping chamber, so as to pump fuel in said pumping chamber.

3. The fuel injection apparatus of claim 2 including inlet and outlet valves for said pumping chamber.

4. The fuel injection apparatus of claim 3 wherein said transferring means comprise:

a diaphragm forming a wall of said pumping chamber; and a pumping plate mounted to said-diaphragm and movable in accordance with the expansions and contractions of said piezoelectric element.

5. The fuel injection apparatus of claim 4 including a pump housing fixed to said main body and enclosing said piezoelectric element.

6. The fuel injection apparatus of claim 5 wherein said diaphragm is held between said main body and said pump housing.

7. The fuel injection apparatus of claim 4 wherein said pumping plate is fixed to said piezoelectric element.

8. The fuel injection apparatus of claim 4 wherein said injector valve drive means comprise a solenoid and a solenoid driver.

9. The fuel injection apparatus of claim 8 including a piezoelectric element driver.

10. The fuel injection apparatus of claim 9 including a fuel injection controller comprising means for controlling both said solenoid driver and said piezoelectric element driver.

11. The fuel injection apparatus of claim 4 wherein said mixing chamber is connected between said pumping chamber and said injector valve, said mixing chamber including an air inlet port for introducing pressurized air to be mixed with the pressurized fuel.

12. The fuel injection apparatus of claim 5 including an elastic plate mounted between said piezoelectric element and said pump housing at a position opposite said pumping plate.

* * * * *